United States Patent [19]

Gunter, Jr.

[11] Patent Number: 4,947,305

[45] Date of Patent: Aug. 7, 1990

[54] LAMP REFLECTOR

[75] Inventor: William D. Gunter, Jr., San Jose, Calif.

[73] Assignee: Vector Technical Group, Inc., Santa Clara, Calif.

[21] Appl. No.: 354,447

[22] Filed: May 19, 1989

[51] Int. Cl.[5] ..... F21V 7/09

[52] U.S. Cl. ..... 362/297; 362/216; 362/218; 362/346; 362/347

[58] Field of Search ..... 362/216, 217, 218, 260, 362/297, 298, 302, 341, 345, 346, 347

[56] References Cited

U.S. PATENT DOCUMENTS 3,363,093 1/1968 Schmitt ..... 362/347

3,900,727 8/1975 Hutz ..... 362/302 X 4,320,442 3/1982 McCamy ..... 362/302 X

*Primary Examiner*—Stephen F. Husar

*Attorney, Agent, or Firm*—Thomas E. Schatzel

[57] ABSTRACT

A lamp reflector includes a light reflecting surface having a transverse cross-section with at least one spiral curve therein beginning behind a light source and curving thereabout with an every increasing radius of curvature. Light striking the spiral curve is reflected around the light source in the direction of the increasing radius of curvature to a location forwardly of the light source. Such a reflector can be adapted for use with light sources of cylindrical, toroidal and spherical shape. The reflector can be adapted for use with a light source enclosed within a transparent or translucent envelope.

14 Claims, 2 Drawing Sheets

LAMP REFLECTOR

BACKGROUND OF THE INVENTION

1. Field of the Invention

This invention relates to illumination devices, and more specifically, to a lamp reflector that redirects light from behind a light source, thereabout, to a location forwardly thereof.

2. Description of the Prior Art

When light is emitted from a source directly opposite to the desired output direction, reflectors have been used to redirect the light towards the desired direction. Often, part of the light is reflected back onto the source, reducing the efficiency of the reflector. A reflector is desired that will redirect light from behind a source, thereabout, to a location forwardly of the source.

An article entitled "Design of Multilamp Nonimaging Laser Pump Cavities" by J.D. Kuppenheimer, Jr., Optical Engineering, December 1988, Vol. 27, No. 12, pages 1067–1071, shows somewhat similar curves for lamp cavities. Chapter 6 of "The Optics of Nonimaging Concentrations" by W.T. Welford and R. Winston, Academic Press, 1978, discloses compound parabolic curves for receiving illumination and concentrating that illumination on cylindrical absorbers. This book also discloses curves that are an involute of a circle for concentrators.

SUMMARY OF THE INVENTION

An object of the present invention is to provide a more efficient lamp reflector that redirects light from behind a source, around the source, to a location forwardly of the source.

Another object of the present invention is to avoid reflecting light back on a light source.

A further object of the present invention is to provide a lamp reflector designed for use with light sources enclosed in transparent or translucent envelopes.

In accordance with the present invention, a lamp reflector includes a light reflecting surface having a transverse cross-section with at least one spiral curve therein beginning behind a light source and curving thereabout with an ever increasing radius of curvature. Light striking the spiral curve is reflected around the light source in the direction of the increasing radius of curvature to a location forwardly of the light source.

Advantages of the present invention include more efficient utilization of light emitted from a source; redirection of light from behind a source, around the source, to a direction forwardly of the source; avoidance of light reflected back on the source; and a lamp reflector design for use with light sources enclosed in transparent or translucent envelopes.

These and other objects and advantages of the invention will no doubt become obvious to those of ordinary skill in the art after having read the following detailed description of the preferred embodiments which are illustrated in the various drawing figures.

IN THE DRAWINGS

DESCRIPTION OF THE PREFERRED EMBODIMENTS

Figure 1:
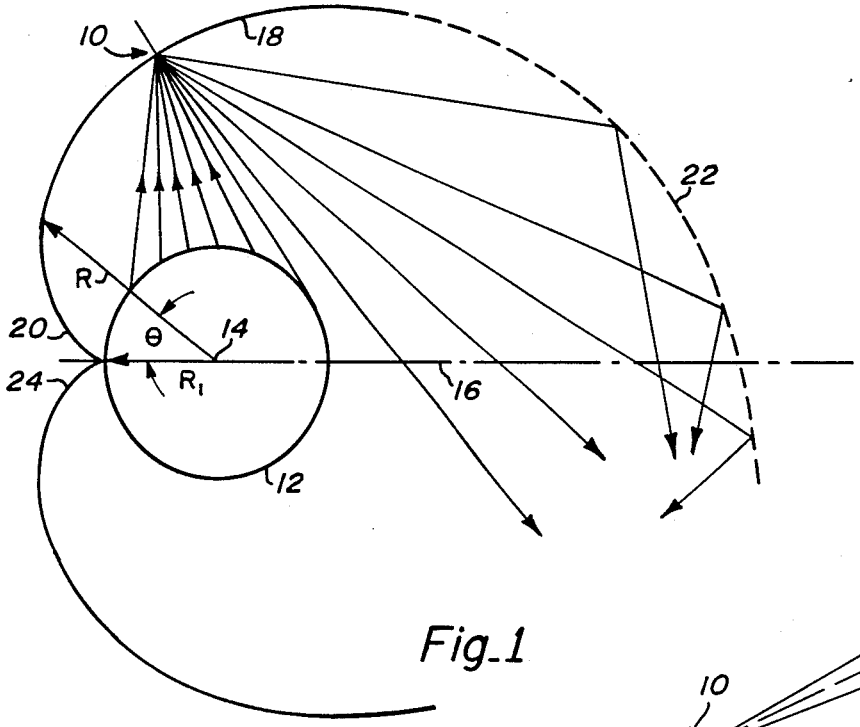
FIG. 1 is a diagrammatic view of a light reflecting surface embodying the present invention shown in relationship with a light source.

With reference to FIG. 1, a lamp reflector is indicated by the general reference numeral 10. This reflector is adapted for use with a light source 12 having a circular cross-section with a center 14 located on a diametrical axis 16 that extends from behind the light source to a location forwardly thereof. The reflector includes a light reflecting surface 18 having a transverse cross-section in the same plane as the circular cross-section of the light source. A spiral curve 20 begins behind the light source and curves clockwise thereabout with an ever increasing radius of curvature R. Light striking the spiral curve is reflected around the light source in the direction of the increasing radius of curvature and forwardly of the light source. The spiral curve 20, indicated in solid line, can be extended further around the light source, as indicated by dashed line 22. Thus, a reflector having a single spiral curve is sufficient for reflecting light around a light source.

The location of points on the spiral curve can be determined by the equation:

$$\phi = \sqrt{R^2 - 1} - \text{arctangent}\sqrt{R^2 - 1}$$

wherein $\theta$ is the angle in radians of a spiral curve radius vector R originating at the center 14 of the circular cross-section relative to a radius $R_1$ of the circular cross-section taken as a value of unity and pointing backward of the light source 12 on the diametrical axis 16. R is the radius vector from center 14 to a point on the spiral curve.

Preferably, the reflector 10 includes a second spiral curve 24, shown in solid line, beginning behind the light source 12. This spiral curves counter-clockwise about the light source and is symmetrical about axis 16 with curve 20. The location of points on the second spiral are determined by the same equation as used for the first spiral, the only difference being that the angle $\theta$ is turned counterclockwise from the radius $R_1$.

Figure 2:
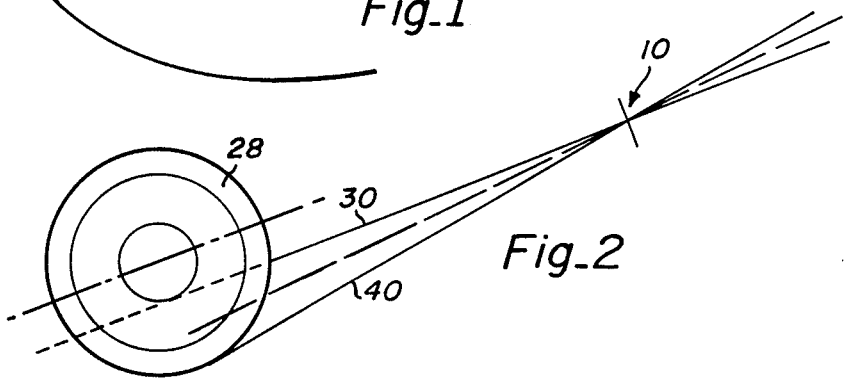
FIG. 2 is a diagrammatic view illustrating the plotting of points on a spiral curve of a reflecting surface adapted for use with a light source enclosed within a transparent or translucent envelope.

Looking now at FIG. 2, it is sometimes desirable to adapt the reflector 10 for use with a light source 26 that is enclosed within a transparent or translucent envelope 28. Refraction corrections need not be made for the envelope. (An accident of the equations). A line 30 is started tangent to the circular cross-section of the light source and extended to the innermost surface of the reflector. Another line 40 is extended tangent to the outer surface of the envelope 28 and to the same point on the reflector. The direction of the reflector at that point is chosen so that normal to the reflector bisects the angle between the two tangent lines 28 and 30.

Spiral curves determined by the equation $\theta = -\sqrt{/R^2-1} -$ arctangent $-\sqrt{/R^2-1}$ or by graphics are the most compact curves that will reflect light around the light source or envelope.

Although no analytical equation has been found for determining spiral curves for sources enclosed within envelopes, such curves can be graphically determined on a computer to better precision than is required for production of the reflectors.

A more simple way to adjust for refraction is to use curve segments suitable for a light source radius of slightly more than the average radius of the inner source and that of its envelope. Light emitted by the source will then pass out through the envelope more or less radically, but when reflected by the reflector, will not strike either the source or its envelope.

Figure 3:
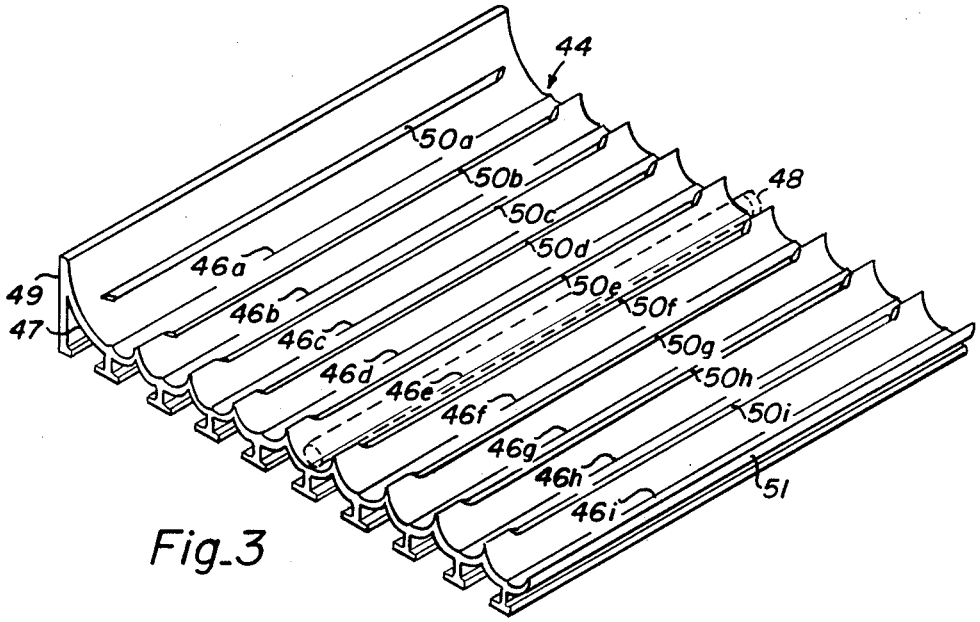
FIG. 3 is a perspective view of a lamp reflector embodying the present invention adapted for use with rows of cylindrical light sources.

As shown in FIG. 3, a lamp reflector, indicated by the general reference numeral 44, has rows of trough-like light reflecting surfaces **46*a*–46*i*, adapted for use with corresponding rows of cylindrical light sources 48, indicated in dashed line. The light reflecting surfaces linearly follow the cylindrical light sources and have spiral curves as previously described. Ventilation openings 50*a*–5*i* are provided in the reflector for admitting cool air to cool the light reflecting surfaces and the cylindrical light sources. It will be noted that the end light reflecting surface 46*a* has a simple curve 47 compounded to the spiral at the maximum radius end and a tangent 49 to the opposite end of the simple curve for distributing the output light beyond the foremost portion of the light source. These reflectors are made in pairs and matched along an edge 51** as the axis of symmetry.

Figure 4:
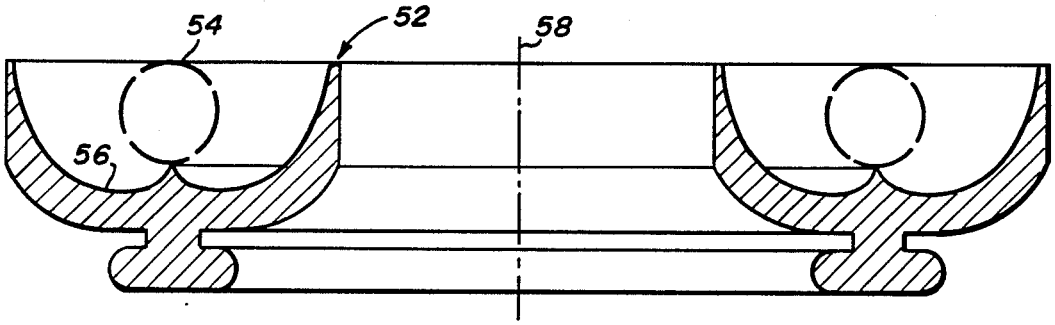
FIG. 4 is a transverse section of a toroidal reflector with a toroidal light source.

Looking now at FIG. 4, a lamp reflector, indicated by the general reference numeral 52, has a toroidal shape to accommodate a toroidal light source 54, such as a circline fluorescent lamp. Light reflecting surfaces 56 in the transverse cross-section are similar to those used for cylindrical light sources, but revolved about an axis of revolution 58 to form the toroidal shape.

Figure 5:
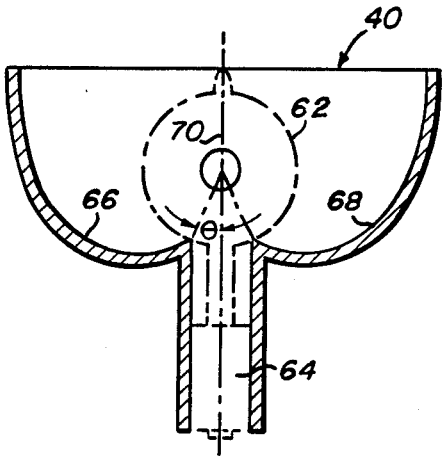
FIG. 5 is a transverse section of a reflector adapted for use with a spherical light source.

With reference to FIG. 5, a lamp reflector, indicated by the general reference numeral 60, is adapted for use with a spherical light source 62. In order to accommodate a base 64 of the light source, the spiral curves of reflecting surfaces 66 and 68 must begin at $\theta$ angles greater than zero. However, the spiral can be calculated using the equation or plotted graphically considering the minimum $\theta$ angles as the points of beginning the spiral curves. The spiral curves are rotated about an axis of revolution 70 to form the lamp reflector for the spherical-shaped light source.

The spiral curves can be modified for various reasons, such as to avoid a radius larger than that of the light source and provide clearance for installation of the light source. Such larger radius can be included in the unity value for the light source. Another modification is to change the spiral curve, but all points on the modified spiral curve must have departures between the spiral curve and a line perpendicular to a radius vector at that point equal to or greater than such a departure at the same radius from a curve defined by the equation $\theta = R^2 - 1 - \text{arctangent } R^2 - 1$ wherein $\theta$ is the angle in radians of a radius vector originating at the center of the circular cross-section relative to a radius of the circular cross-section pointing backward of the light source and R is the radius vector of the equation curve from the center of the circular cross-section to a point on the equation curve.

From the foregoing description it will be seen that the lamp reflector redirects light from behind a source, around the source, to a location forwardly of the source. This reflector avoids reflecting light back on the source. Lamp reflectors can be designed for use with light sources enclosed in transparent or translucent envelopes.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A lamp reflector for use with a light source that has a circular cross-section from which light is emitted about the circumference thereof and that emitted light is desired to be directed forward of the light source, said lamp reflector comprising:

a light reflecting surface having a transverse cross-section in the plane of the circular cross-section of the light source, and at least one spiral curve in the transverse cross-section of the light reflecting surface, said spiral curve beginning behind the light source and curving thereabout with an ever increasing radius of curvature, whereby light striking the spiral curve is reflected around the light source in the direction of the increasing radius of curvature and forwardly thereof.

2. The lamp reflector of claim 1 wherein, all points on the spiral curve have departures between the spiral curve and a line perpendicular to a radius vector at that point equal to or greater than such a departure at the same radius from a curve defined by the equation $\theta = -\sqrt{R^2-1} -$ arctangent $-\sqrt{R^2-1}$ wherein $\theta$ is the angle in radians of a radius vector originating at the center of the circular cross-section relative to a radius of the circular cross-section pointing backward of the light source and R is the radius vector of the equation curve from the center of the circular cross-section to a point on the equation curve.

3. The lamp reflector of claim 1 wherein, said spiral curve is designed to avoid a radius larger than that of the source.

4. A lamp reflector for use with a light source that has a circular cross-section from which light is emitted about the circumference thereof and that emitted light is desired to be directed forward of the light source, said circular cross-section having a center and a radius that is taken as a value of unity, said lamp reflector comprising:

a light reflecting surface having a transverse cross-section in the plane of the circular cross-section of the light source, and at least one spiral curve in the transverse cross-section of the light reflecting surface, said spiral curve beginning behind the light source and curving thereabout according to the equation $\theta = -\sqrt{R^2-1} -$ arctangent $-\sqrt{R^2-1}$ wherein $\theta$ is the angle in radians of a spiral curve radius vector originating at the center of the circular cross-section relative to a radius of the circular cross-section pointing backward of the light source and R is the radius vector of the spiral curve from the center of the circular cross-section to a point on the spiral curve, whereby light striking the spiral curve is reflected around the light source and forwardly thereof.

5. The lamp reflector of claim 4 further comprising:

a second spiral curve in the transverse cross-section of the light reflecting surface, said second spiral curve beginning behind the light source and curving thereabout with an ever increasing radius of curvature, one spiral curve curving clockwise about the light source and the other spiral curve curving counterclockwise about the light source.

6. The lamp reflector of claim 5 wherein, the ends of the symmetrical spiral curves meet the source cross-section at clockwise or counterclockwise $\theta$ angles that are greater than zero.

7. A lamp reflector for use with a light source that has a circular cross-section enclosed in a transparent envelope from which light is emitted about the circumference of the envelope and that emitted light is desired to be directed forward of the light source, said lamp reflector comprising:

a light reflecting surface having a transverse cross-section in the plane of the circular cross-sections of the light source and the envelope, and at least one spiral curve in the transverse cross-section of the light reflecting surface, said spiral curve beginning behind the light source and envelope and curving thereabout with an ever increasing radius of curvature, said curve being such that a normal to the spiral curve at any point bisects the angle between the line from the point to a tangent of the envelope and a line from the point to a tangent to the source, whereby light emitted by the light source will substantially pass radially through the envelope striking the spiral curve and being reflected around the light source to locations forwardly thereof.

8. The lamp reflector of claim 7 further including:

a second spiral curve in the transverse cross-section of the light reflecting surface, said second spiral curve beginning behind the light source and curving thereabout with an ever increasing radius of curvature, one spiral curve curving clockwise about the light source and the other spiral curve curving counterclockwise about the light source.

9. The lamp reflector of claim 8 wherein, the light source has a cylindrical shape and said light reflecting surface linearly follows the cylindrical light source.

10. The lamp reflector of claim 7 further including:

a second spiral curve in the transverse cross-section of the light reflecting surface, said second spiral curve beginning behind the light source and curving thereabout with an ever increasing radius of curvature, one spiral curve curving clockwise about the light source and the other spiral curve curving counterclockwise about the light source, said light source having a toroidal shape and said light reflecting surface having an annular shape with both spiral curves following the torodial light source.

11. The lamp reflector of claim 7 wherein, said light source has a spherical shape with the circular cross-section revolved about its axis extending forward and backward of the light source and said spiral curve is revolved about the same axis.

12. The lamp reflector of claim 7 wherein, said transverse cross-section of the light reflecting surface includes a second curve compounded to the maximum radius end of the spiral curve for distributing the output light beyond the foremost portion of the light source.

13. The lamp reflector of claim 7, wherein, the spiral curve layout is determined by graphics.

14. The lamp reflector of claim 13 further including:

a second spiral curve in the transverse cross-section of the light reflecting surface, said second spiral curve beginning behind the light source and curving thereabout with an ever increasing radius of curvature, one spiral curve curving clockwise about the light source and the other spiral curve curving counterclockwise about the light source.

* * * * *